US009534826B2

(12) United States Patent
Fotiadis et al.

(10) Patent No.: US 9,534,826 B2
(45) Date of Patent: Jan. 3, 2017

(54) REFRIGERATOR HAVING A DEFROST HEATER

(75) Inventors: Panagiotis Fotiadis, Giengen (DE); Jochen Härlen, Königsbronn (DE); Harald Joksch, Vöhringen (DE)

(73) Assignee: BSH Hausgeräte GmbH, Munich (DE)

( * ) Notice: Subject to any disclaimer, the term of this patent is extended or adjusted under 35 U.S.C. 154(b) by 1097 days.

(21) Appl. No.: 13/131,609

(22) PCT Filed: Nov. 24, 2009

(86) PCT No.: PCT/EP2009/065748
§ 371 (c)(1),
(2), (4) Date: May 27, 2011

(87) PCT Pub. No.: WO2010/078998
PCT Pub. Date: Jul. 15, 2010

(65) Prior Publication Data

US 2011/0225993 A1 Sep. 22, 2011

(30) Foreign Application Priority Data

Dec. 18, 2008 (DE) ..... 10 2008 054 935

(51) Int. Cl.
*F25D 21/00* (2006.01)
*F25D 21/08* (2006.01)

(52) U.S. Cl.
CPC ..... *F25D 21/002* (2013.01); *F25D 21/08* (2013.01); *F25D 2700/10* (2013.01)

(58) Field of Classification Search
CPC .... F25D 21/002; F25D 21/08; F25D 2700/10; F25B 2347/023; F25B 47/006; F24F 11/00; G05D 23/00; G06F 1/20; H05K 7/20
(Continued)

(56) References Cited

U.S. PATENT DOCUMENTS 3,898,860 A * 8/1975 Shepherd ..... F25D 17/065 62/140
3,899,896 A * 8/1975 Bryant ..... 62/155
(Continued)

FOREIGN PATENT DOCUMENTS

EP 0285690 A1 10/1988
GB 2340922 A 3/2000
KR WO 2009134052 A2 * 11/2009 ..... F25D 21/08

OTHER PUBLICATIONS

International Search Report PCT/EP/2009/065748.
Report of Examination including National Search Report Dated Nov. 22, 2012.

*Primary Examiner* — Len Tran
*Assistant Examiner* — Kun Kai Ma
(74) *Attorney, Agent, or Firm* — Nixon & Vanderhye PC

(57) ABSTRACT

A refrigeration appliance includes an evaporator and a defrost heater which periodically subjects the evaporator to a defrost process, A temperature sensor is disposed at least in proximity to the evaporator and is adapted for switching off the defrost heater once the temperature sensor detects a predetermined defrost temperature. The temperature sensor provides a predetermined defrost temperature profile having first, second and third time segments. A first defrost temperature during the first time segment changes to a second defrost temperature during the second time segment, and holds the second defrost temperature during the third time segment.

28 Claims, 2 Drawing Sheets

(58) Field of Classification Search
USPC ..... 62/156, 155, 151, 150; 700/278, 153, 700/202, 276, 300
See application file for complete search history.

(56) References Cited

U.S. PATENT DOCUMENTS 4,345,441 A * 8/1982 Hansen ..... F25D 21/02 62/140
4,432,211 A * 2/1984 Oishi ..... G05D 23/2401 219/497
4,812,622 A * 3/1989 Takeda ..... A23L 3/365 126/21 A
4,932,217 A * 6/1990 Meyer ..... F25D 21/002 219/492
4,974,417 A * 12/1990 Levine ..... F25D 21/006 62/156
5,187,084 A * 2/1993 Hallsby ..... 435/91.2
5,332,028 A * 7/1994 Marris ..... 165/233
5,379,608 A 1/1995 Ishimaru et al.
6,014,865 A 1/2000 Kim et al.
6,032,471 A 3/2000 Choi
6,058,723 A 5/2000 Kusunoki et al.
6,058,724 A * 5/2000 Park ..... F25D 21/002 62/153
6,993,418 B2 * 1/2006 Stewart ..... G05D 23/1931 700/153
2001/0045098 A1 * 11/2001 Derryberry ..... F24F 3/14 62/139
2005/0161327 A1 * 7/2005 Palmieri ..... B01L 3/50273 204/450
2006/0165154 A1 * 7/2006 Usui ..... 374/208
2007/0045265 A1 * 3/2007 McKinzie, II ..... C07C 4/02 219/207
2008/0066478 A1 * 3/2008 Okamoto ..... F04C 18/322 62/151
2008/0129322 A1 * 6/2008 Taylor ..... G05D 23/1919 324/750.04
2010/0218528 A1 * 9/2010 Yakumaru ..... F25B 47/022 62/234
2011/0073586 A1 * 3/2011 Lim ..... F25D 21/08 219/546

* cited by examiner

REFRIGERATOR HAVING A DEFROST HEATER

BACKGROUND OF THE INVENTION

The present invention relates to the field of refrigeration appliances, in particular the field of household refrigeration appliances.

Modern household refrigeration appliances have defrost heaters, which are provided to thaw unwanted frost and ice. In this process a defrost period is controlled by a temperature sensor positioned for example on the evaporator of the refrigeration appliance, said temperature sensor detecting a predefined final defrost temperature, on the reaching of which the defrost heater is switched off or remains switched on for a further minimum defrost time, it only being possible to switch the defrost heater off within the minimum defrost time, if a safety temperature threshold is exceeded.

However if the preset final defrost temperature is reached too quickly, the heat emitted by the defrost heater cannot be distributed evenly in the evaporator. This means that the unwanted ice is not thawed at a point further away from the temperature sensor, resulting in uneven defrosting.

BRIEF SUMMARY OF THE INVENTION

The object of the present invention is to create a more efficient defrost concept for refrigeration appliances. This object is achieved by the features of the independent claims. Advantageous developments are set out in the dependent claims.

The invention is based on the knowledge that more efficient defrosting can be achieved by providing for at least two different predetermined defrost temperatures within the same defrost process. So for example a higher temperature can be set at the start of the defrost process so that more reliable defrosting can be achieved in the evaporator as a whole in a short defrost period. Then a lower defrost temperature can be set for example to ensure even heat distribution in the evaporator in a longer defrost period. This allows even defrosting to be achieved in an energy-efficient manner.

According to one aspect the invention relates to a refrigeration appliance, in particular a household refrigeration appliance, having an evaporator which is subjected from time to time to a defrost process of a defrost heater, which is switched off by a temperature sensor disposed at least in proximity to the evaporator once the temperature sensor reaches a predetermined temperature or after a predetermined time period, wherein the defrost heater is configured to produce at least two different defrost temperatures according to a predetermined defrost temperature profile during a defrost process. The predetermined defrost temperature profile can for example provide for a higher temperature to be set at the start of the defrost process and for a second, lower defrost temperature to be set after the end of a predetermined time interval and to be maintained until the end of the defrost process.

According to one embodiment the predetermined defrost temperature profile comprises a first defrost temperature segment with a first mean defrost temperature, an intermediate defrost temperature segment, in particular a ramped defrost temperature segment, following the first defrost temperature segment and a third defrost temperature segment with a mean second defrost temperature following the intermediate defrost temperature segment.

According to one embodiment the intermediate defrost temperature segment is falling, in particular continuously falling.

According to one embodiment the first defrost temperature segment has a higher temperature than the third defrost temperature segment.

According to one embodiment the defrost temperature of the first defrost temperature segment and the second defrost temperature segment is at least approximately constant.

According to one embodiment a control facility is provided to control the defrost heater, which is configured to produce the first defrost temperature within a first predetermined time interval and to produce a defrost temperature that falls in a linear manner within a second predetermined time interval until the second constant defrost temperature is reached.

According to one embodiment the defrost temperature profile comprises a plurality of different constant defrost temperatures with defrost temperature segments of a predetermined time period that rise or fall in a ramped manner disposed therebetween.

According to one embodiment a control facility is provided to execute the defrost process within a predetermined time period.

According to one embodiment the refrigeration appliance is configured as a no-frost refrigeration appliance having an evaporator disposed outside a chamber to be cooled, which is configured in particular as a finned evaporator having a temperature sensor.

According to a further aspect the invention relates to a method for regulating a defrost process of a refrigeration appliance which comprises producing a first defrost temperature with a first temperature level for a first time period, changing the first defrost temperature to a second temperature level within a second time period and holding the second temperature level as a second defrost temperature for a third time period.

According to one embodiment the first defrost temperature is reduced, in particular is continuously reduced, to the second defrost temperature.

BRIEF DESCRIPTION OF THE DRAWINGS

Further embodiments are described in more detail with reference to the accompanying figures, in which.

DETAILED DESCRIPTION OF EXEMPLARY EMBODIMENTS OF THE PRESENT INVENTION

Figure 1A:
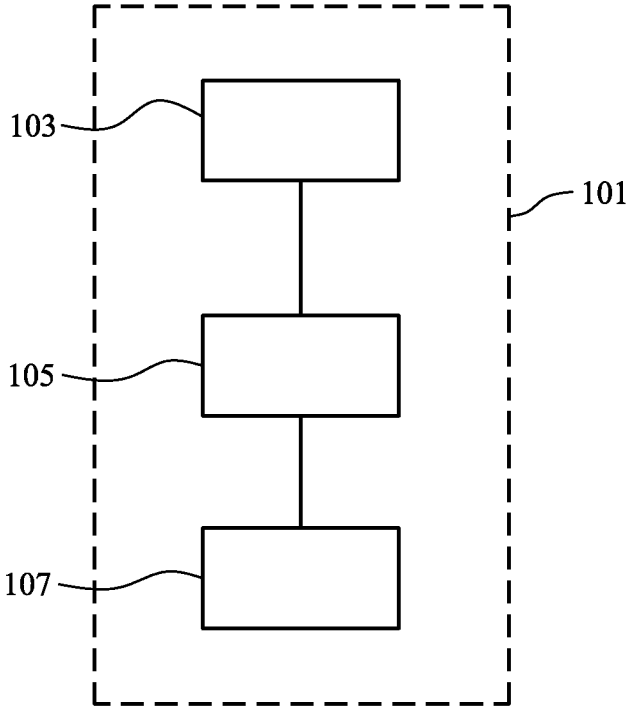
FIG. 1A shows a basic block diagram of a defrost heater.
Figure 1B:
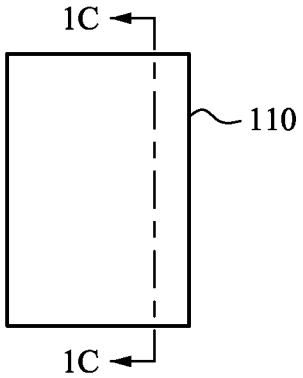
FIG. 1B is a front view of a refrigeration appliance according to an example of the disclosed technology.
Figure 1C:
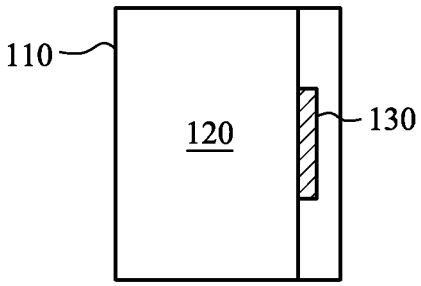
FIG. 1C is a cross-sectional view along the line 1C-1C in FIG. 1B.

FIG. 1A shows a block diagram of a defrost heater 101, which can be used for example in a household refrigeration appliance 110 (FIGS. 1B and 1C). The defrost heater 101 comprises a defrost heater 103, a control facility 105 and a temperature sensor 107. The temperature sensor 107 is provided to detect the actual defrost temperature and forward this to the control facility 105. The control facility 105 controls the defrost heater 103 according to a predetermined defrost temperature profile so that the predetermined defrost temperature profile is established over time at the temperature sensor. Referring to FIG. 1B, a refrigeration appliance 100 is shown. As can be seen in FIG. 1C, the refrigeration appliance includes a chamber to be cooled 120 and an evaporator (e.g., a finned evaporator 130) disposed outside the chamber to be cooled.

Figure 2:
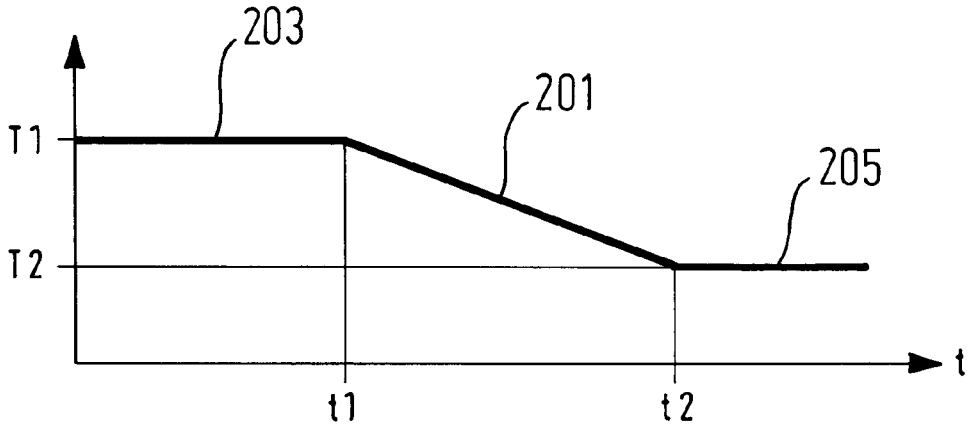
FIG. 2 shows an exemplary defrost temperature profile.

FIG. 2 illustrates an example of a defrost temperature profile with a linear, ramped intermediate defrost temperature segment 201, which connects a first constant defrost temperature 203 to a second constant defrost temperature 205. The first defrost temperature 203 has a temperature value T1 for example, which is maintained until a time t1. The defrost temperature is then reduced until a time t2, when the second constant defrost temperature 205 with the temperature value T2 is reached. The first constant defrost temperature 203 is for example higher than the second constant defrost temperature 205 and is only set for a time period, which starts for example at the start of the defrost process and is maintained for a short time, for example 1 s, 2 s, 3 s, 5 s, 10 s or 30 s. In contrast the second defrost temperature 205 is maintained for example until the end of the entire defrost process. It is thus possible to achieve an even defrost effect with generally reduced heat output.

The invention claimed is:

1. A household refrigeration appliance, comprising:
an evaporator;
a defrost heater disposed in proximity to the evaporator and controlled to periodically subjecting the evaporator to a defrost process;
a temperature sensor disposed at least in proximity to the evaporator; and
a controller configured to:
switch off the defrost heater once the temperature sensor detects a predetermined defrost temperature;
set the defrost heater to produce at least a first target temperature output and a second target temperature output while the defrost heater is activated and outputting heat, the second target temperature output being lower than the first target temperature output; and
control the defrost heater to provide the evaporator with a predetermined evaporator defrost temperature profile having first, second and third time segments while the defrost heater is activated and outputting heat, wherein
during the first time segment and while the defrost heater is activated and outputting heat to the evaporator, the defrost heater is controlled to produce the first target temperature output, the first target temperature output from the defrost heater producing a first defrost temperature at the evaporator during the first time segment,
during the second time interval and while the defrost heater is activated and outputting heat to the evaporator, the defrost heater is controlled to change from producing the first target temperature output to the second target temperature output, and
during the third time interval and while the defrost heater is activated and outputting heat to the evaporator, the defrost heater is controlled to hold the second temperature output, the second target temperature output from the defrost heater producing a second defrost temperature at the evaporator during the third time segment.

2. The household refrigeration appliance of claim 1, wherein the first defrost temperature is a first mean defrost temperature and the second defrost temperature is a second mean defrost temperature.

3. The household refrigeration appliance of claim 2, wherein the second time segment is an intermediate defrost temperature segment having a ramped defrost temperature provided by the defrost heater.

4. The household refrigeration appliance of claim 3, wherein the defrost temperature provided by the defrost heater in the intermediate defrost temperature segment is falling.

5. The household refrigeration appliance of claim 3, wherein the defrost temperature provided by the defrost heater in the intermediate defrost temperature segment is continuously falling.

6. The household refrigeration appliance of claim 1, wherein the first defrost temperature segment has a constant higher temperature provided by the defrost heater than a constant temperature provided by the defrost heater during the third defrost temperature segment.

7. The household refrigeration appliance of claim 1, wherein the defrost temperature provided by the defrost heater during the first defrost temperature segment and the defrost temperature provided by the defrost heater during the third defrost temperature segment are at least approximately constant.

8. The household refrigeration appliance of claim 1, wherein the controller controls the defrost heater to produce the first defrost temperature within the first predetermined time interval and to produce a defrost temperature that falls in a linear manner within the second predetermined time interval until a second constant defrost temperature is reached.

9. The household refrigeration appliance of claim 1, wherein the predetermined defrost temperature profile comprises defrost temperature time segments having respective predetermined time intervals, and defrost temperature time segments disposed there between in which the defrost temperature changes in a ramped manner.

10. The household refrigeration appliance of claim 1, wherein the controller is configured to carry out the defrost process within a predetermined time interval.

11. The household refrigeration appliance of claim 1, constructed in the form of a no-frost refrigeration appliance, with the evaporator being disposed outside a chamber to be cooled.

12. The household refrigeration appliance of claim 11, wherein the evaporator is a finned evaporator having a temperature sensor.

13. The household refrigeration appliance of claim 1, wherein the first defrost temperature is reduced to the second defrost temperature during the second time interval.

14. The household refrigeration appliance of claim 1, wherein the first defrost temperature is continuously reduced to the second defrost temperature.

15. The household refrigeration appliance of claim 1, wherein the first time segment and the third time segment are approximately equal in length.

16. A method for regulating a defrost process for a household refrigeration appliance having an evaporator, a defrost heater disposed in proximity to the evaporator, and a temperature sensor disposed in proximity to the evaporator, the defrost heater configured to periodically subjecting the evaporator to a defrost process and to provide a predetermined evaporator defrost temperature profile having first, second and third time segments, said method comprising the steps of:
a controller activating the defrost heater to output heat and switching off the defrost heater once the temperature sensor detects a predetermined defrost temperature;

the controller causing the defrost heater to produce a first target temperature output while the defrost heater is activated and outputting heat, the first target temperature output from the defrost heater producing a first defrost temperature at the evaporator during the first time segment;

the controller causing the defrost heater to change from producing the first target temperature output to a second target temperature output, the second target temperature output being lower than the first target temperature output, and a change in defrost heater output occurs during the second time segment and causing a decline in the temperature at the evaporator; and the controller causing the defrost heater to maintain the second temperature output during the third time segment of the predetermined defrost temperature profile while the defrost heater is activated and outputting heat, the second target temperature output from the defrost heater producing a second defrost temperature at the evaporator during the third time segment, and the third time segment comprising the second defrost temperature which is substantially constant.

17. The method of claim 16, wherein the first defrost temperature is a first mean defrost temperature and the second defrost temperature is a second mean defrost temperature.

18. The method of claim 16, wherein the intermediate defrost temperature segment has a ramped intermediate defrost temperature.

19. The method of claim 16, wherein the defrost temperature in the intermediate defrost temperature segment is falling.

20. The method of claim 19, wherein the defrost temperature in the intermediate defrost temperature segment is continuously falling.

21. The method of claim 16, wherein the first defrost temperature segment has a constant higher temperature provided by the defrost heater than a constant temperature provided by the defrost heater during the third defrost temperature segment.

22. The method of claim 16, wherein the defrost temperature provided by the defrost heater during the first time segment and the defrost temperature provided by the defrost heater during the third time segment are at least approximately constant.

23. The method of claim 16, wherein the first defrost temperature is produced within a first predetermined time interval and the defrost temperature falls in a linear manner within a second predetermined time interval until the second defrost temperature is reached.

24. The method of claim 16, wherein said predetermined defrost temperature profile comprises a plurality of different constant defrost temperatures in respective defrost temperature segments having respective predetermined time intervals and defrost temperature segments disposed there between wherein said defrost temperatures change in a ramped manner.

25. The method of claim 16, wherein the defrost process is carried out within a predetermined time interval.

26. The method of claim 16, wherein the first defrost temperature is reduced to the second defrost temperature within a predetermined time interval.

27. The method of claim 16, wherein the first defrost temperature is continuously reduced to the second defrost temperature.

28. The method of claim 16, wherein the time intervals of the first segment and the third segment are approximately equal in length.

* * * * *